US009365325B2

(12) United States Patent
Bodner

(10) Patent No.: US 9,365,325 B2
(45) Date of Patent: Jun. 14, 2016

(54) CHILD PROOF CONTAINERS

(71) Applicant: Michelle Bodner, New York, NY (US)

(72) Inventor: Michelle Bodner, New York, NY (US)

( * ) Notice: Subject to any disclaimer, the term of this patent is extended or adjusted under 35 U.S.C. 154(b) by 0 days.

(21) Appl. No.: 14/301,784

(22) Filed: Jun. 11, 2014

(65) Prior Publication Data

US 2015/0360823 A1 Dec. 17, 2015

(51) Int. Cl.
*B65D 33/06* (2006.01)
*B65D 33/25* (2006.01)
*B65D 33/16* (2006.01)

(52) U.S. Cl.
CPC ..... *B65D 33/25* (2013.01); *B65D 33/06* (2013.01); *B65D 33/1683* (2013.01); *B65D 2215/00* (2013.01)

(58) Field of Classification Search
CPC ..... B65D 2215/00; B65D 2215/02; B65D 2215/04; A44B 19/26; A44B 19/28; A44B 19/285
USPC ..... 383/15, 5, 202, 33–35, 64; 24/30.5 R
See application file for complete search history.

(56) References Cited

U.S. PATENT DOCUMENTS 2,049,113 A * 7/1936 Formoso ..... 206/1.5
2,616,470 A * 11/1952 Rifkin ..... 383/5
2,678,671 A * 5/1954 Rifkin ..... 383/68
3,313,470 A 4/1967 Renner et al.
3,363,827 A 1/1968 Renner et al.
3,452,922 A 7/1969 Robert
3,477,634 A 11/1969 Kamins et al.
3,529,317 A 9/1970 Schwarzkopf
3,558,039 A 1/1971 Schmidt
3,808,649 A * 5/1974 Ausnit ..... 383/63
3,987,958 A 10/1976 Kamins et al.
4,282,911 A 8/1981 Sumitomo
4,514,876 A * 5/1985 Houlberg ..... 16/406
4,641,360 A 2/1987 Frank
4,707,883 A * 11/1987 Irani et al. ..... 16/407
4,812,056 A 3/1989 Zieke
4,964,739 A 10/1990 Branson et al.
5,681,115 A 10/1997 Diederich et al.
5,711,442 A 1/1998 Kusz
5,813,092 A * 9/1998 Greenfield et al. ..... 16/425
5,931,582 A 8/1999 Nichols
5,944,423 A 8/1999 Rabin et al.
7,670,052 B2 3/2010 Chaturvedi
7,913,839 B2 * 3/2011 Fawcett et al. ..... 206/315.3
8,196,442 B1 * 6/2012 Lassen et al. ..... 70/64
2006/0182369 A1 * 8/2006 Schneider et al. ..... 383/10
2007/0071367 A1 * 3/2007 Buchman ..... 383/64

* cited by examiner

*Primary Examiner* — Jes F Pascua
(74) *Attorney, Agent, or Firm* — Byrne Poh LLP

(57) ABSTRACT

Child proof containers are provided. In some embodiments, the child proof container comprise: a removal tool having a first end; a pouch with a first edge and a second edge that together form an opening to the pouch; a first handle portion that is attached to the first edge and that includes an opening sized to receive the first end of the removal tool; a second handle portion that is attached to the second edge, that is configured to fit into a cavity in the first handle portion, that interlocks with the first handle portion when in the cavity, and that can be pushed out of the first handle portion using the first end of the removal tool.

8 Claims, 4 Drawing Sheets

CHILD PROOF CONTAINERS

TECHNICAL FIELD

The disclosed subject matter relates to child proof containers which have an interlocking closure device and an opening tool.

BACKGROUND INFORMATION

A wide variety of child proof containers exist today. For example, pill and chemical containers frequently come with caps that require a user to press the caps downward while simultaneously turning the caps in order to remove them and access the contents of the containers.

Unfortunately, however, these containers do not lend themselves to usage with larger items that are more suitably placed in a bag. Additionally, they are not readily labeled or displayable in a retail environment.

Accordingly, it is desirable to provide a new type of child proof container.

SUMMARY

Child proof containers are provided. In some embodiments, the child proof containers comprise: a removal tool having a first end; a pouch with a first edge and a second edge that together form an opening to the pouch; a first handle portion that is attached to the first edge and that includes an opening sized to receive the first end of the removal tool; a second handle portion that is attached to the second edge, that is configured to fit into a cavity in the first handle portion, that interlocks with the first handle portion when in the cavity, and that can be pushed out of the first handle portion using the first end of the removal tool.

BRIEF DESCRIPTION OF THE DRAWINGS

Various objects, features, and advantages of the disclosed subject matter can be more fully appreciated with reference to the following detailed description of the disclosed subject matter when considered in connection with the following drawings, in which like reference numerals identify like elements.

DETAILED DESCRIPTION

In accordance with various embodiments, as described in more details below, child proof containers which have a pouch, an interlocking closure device with multiple small arcuate slots, and an opening tool are provided.

In some embodiment, an interlocking closure device is intended for use with a pouch that can be closed and child-protected by the interlocking closure device.

In some embodiments, the interlocking closure device can comprise two fastening strips disposed along top edge portion of the opening of the pouch. In some embodiments, the two fastening strips can be interconnected by manual pressure for closing the pouch, and preventing a child from opening the pouch.

In some embodiments, the pouch can be formed of a durable material, such as plastic polyethylene terephthalate (PET), polyvinyl chloride (PVC), polyester, nylon, synthetic resin, polyamide resin, etc., or from a combination thereof.

In some embodiments, an opening tool can be provided for opening the interlocking closure device.

Figure 1:
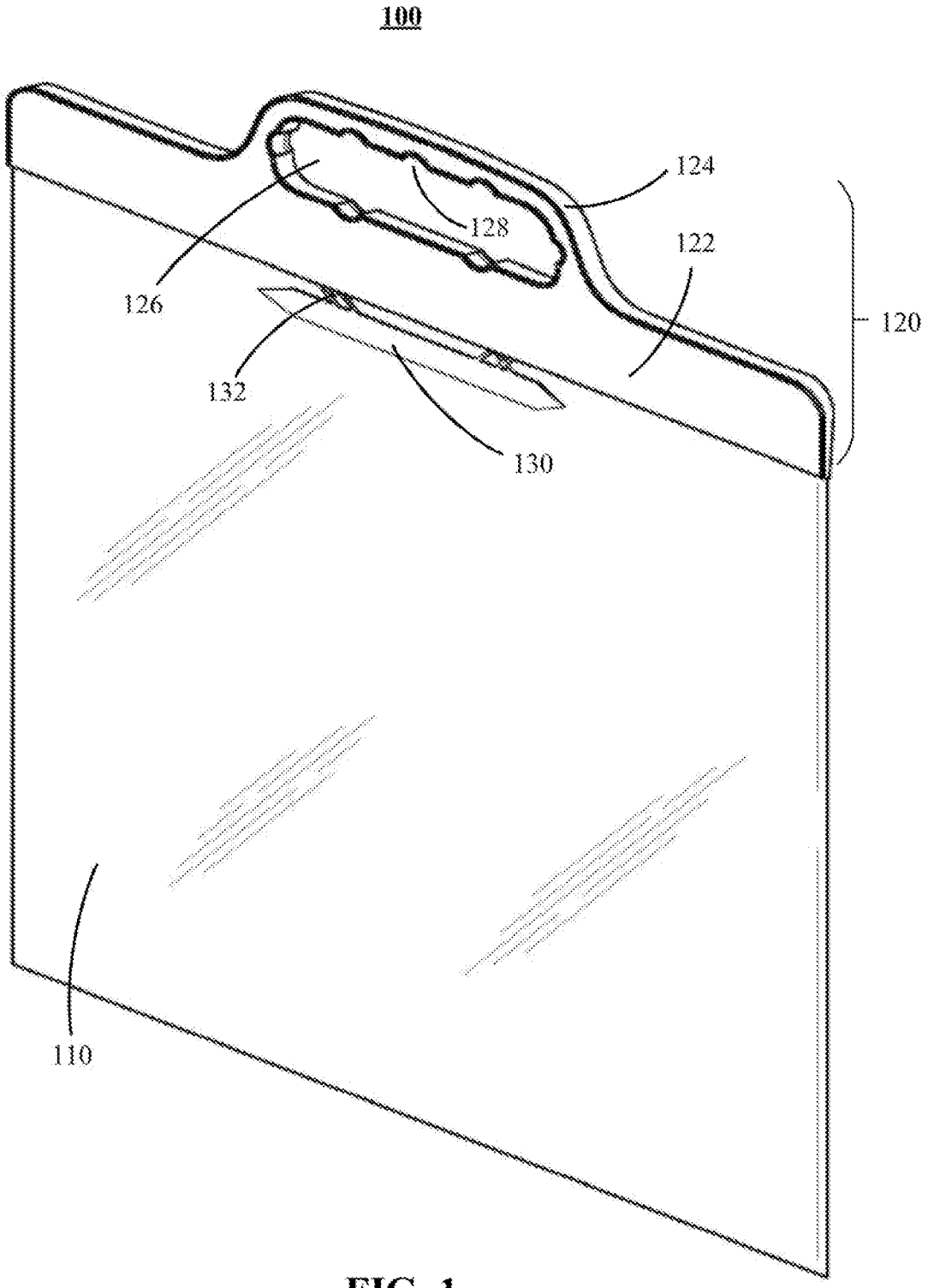
FIG. 1 is a perspective view showing a closed child proof container incorporating a pouch, an interlocking closure device with multiple small arcuate slots, and an opening tool in accordance with some embodiments of the disclosed subject matter.

Turning to FIG. 1, an example 100 of a closed child proof container incorporating a pouch, an interlocking closure device with multiple small arcuate slots, and an opening tool in a perspective view is shown in accordance with some embodiments. As illustrated, the child proof container 100 comprises a pouch 110, an interlocking closure device 120 with multiple small arcuate slots 128, and an opening tool 130.

In some embodiments, pouch 110 can be in the form of any suitable top opening bag, such as a three-side seal pillow bag, a bottom filled gusset bag, a side gusset stand up bag, a fin/lap seal doy style bag, etc. In some embodiments, pouch 110 can be made of any suitable material, such as plastic polyethylene terephthalate (PET), polyvinyl chloride (PVC), polyester, nylon, synthetic resin, polyamide resin, etc.

In some embodiment, interlocking closure device 120 can comprise a base 122 and a carrying handle 124 and multiple small arcuate slots 128 on the handle's interior side. Interlocking closure device 120 can be made of any suitable material which is resilient and durable, such as acrylonitrile butadiene styrene (ABS), polypropylene (PP), polystyrene (PS), thermoplastic elastomers (TPE), etc.

In some embodiments, base 122 and carrying handle 124 can be integrated as a single body, which can result in an improved stress distribution in material of base 122 attended by an improved weight distribution between pouch 110 and carrying handle 124 when pouch 110 is filled and carrying handle 124 is stressed.

As illustrated, base 122 can be extended along the full width and partial sides of the pouch, which can provide tension support when pouch 110 is under load and hide entry seams. A carrying handle 124 with a rounded shape can be formed above base 122. Between base 122 and carrying handle 124, a hand opening 126 is formed in a central portion of interlocking closure device 120. Hand opening 126 includes straight sides and multiple arcuate sides 128 (which may not be to scale in the figures) which are directed outwardly towards the opening. Arcuate sides 128 can improve friction between a user's hand and carrying handle 124 when the user is holding carrying handle 124. In some embodiments, the diameter of each arcuate side 128 can be smaller than the size of a typical five years old child's fingertip (e.g., 0.25").

In some embodiments, opening tool 130 can be connected with base 122 by one or more connecting bridges 132. Opening tool 130 can be made of the same material as that used for interlocking closure device 120.

Figure 2:
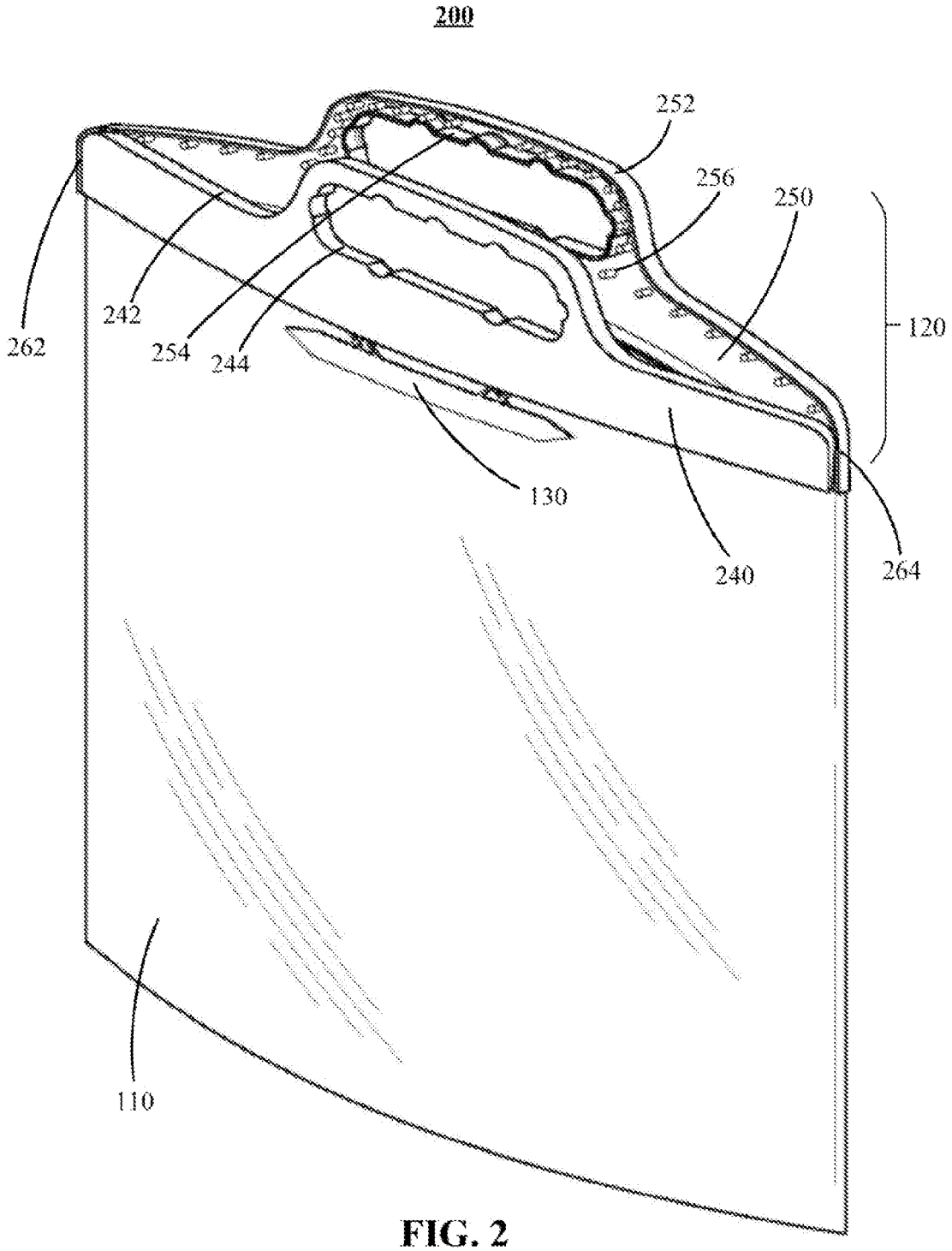
FIG. 2 is a perspective view showing an opened child proof container incorporating a pouch, an interlocking closure device with multiple small arcuate slots, and an opening tool in accordance with some embodiments of the disclosed subject matter.

FIG. 2 shows a perspective view of an opened child proof container 200 incorporating pouch 110, interlocking closure device 120, and opening tool 130 in accordance with some embodiments. As illustrated, interlocking closure device 120 has two fastening strips 240 and 250, which can be interlocked with each other. In some embodiments, both of the fastening strips 240 and 250 have a smooth and flat outer surface, and a concave inner surface which contains a plurality of protruding embossments.

In fastening strip 250, a plurality of protruding embossments 256 are male type (e.g., as a small cylinder shape), while in fastening strip 240, a matching plurality of protruding embossments are female type (e.g., as a small hollow cylinder shape). The positions of the male type protruding embossments 256 are distributed inside of the concave inner surface of fastening strip 250, and correspond to the positions of the female type protruding embossments distributed inside of the concave inner surface of fastening strip 240.

In some embodiments, the male type protruding embossments 256 can be pressed into the cavities of the matching female type protruding embossments by pressing on the outsides of fastening strip 240 and 250. The material from which male type protruding embossments 256, as well as the matching female type protruding embossments, is made can possess sufficient resiliency to permit adequate flexing during engagement, in some embodiments.

Fastening strips 240 and 250 are adapted to be interlocked between a first end 262 and a second end 264. To perform the locking operation for interlocking closure device 120, a user can simply press the flat outer surfaces of the two fastening strips 240 and 250 from the first end 262 to the second end 264 to make all of plurality of male type protruding embossments 256 be pressed into the cavities of the matching female type protruding embossments.

In some embodiments, fastening strip 250 has an enlarged outer edge 252 and a contracted inner edge 254 compared respectively to the outer edge 242 and inner edge 244 of fastening strip 240, so that the opening of the concave inner surface of fastening strip 250 is oversized compared to the size of fastening strip 240 in order to allow the entire fastening strip 240 to be embedded into the opening in the concave inner surface of fastening strip 250.

Figure 3:
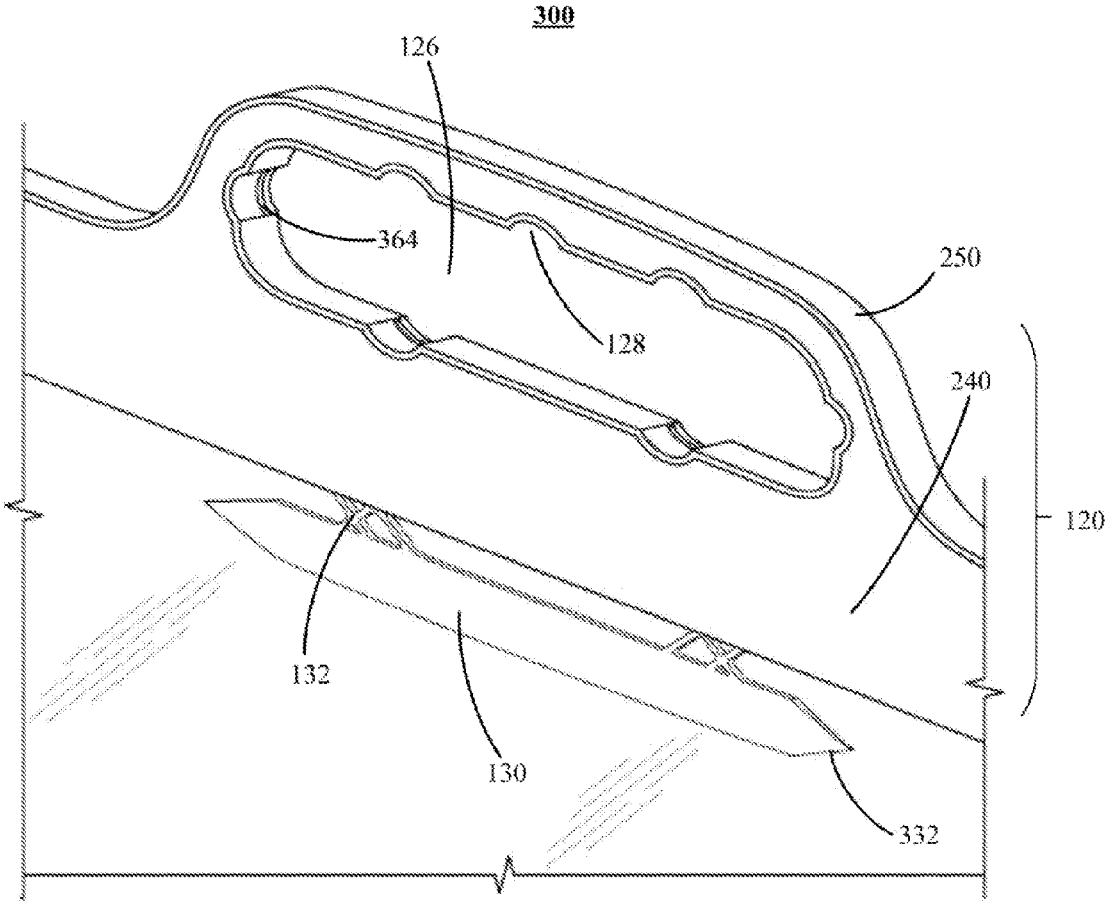
FIG. 3 is a fragmentary view showing an expanded view of an interlocking closure device of a child proof container in accordance with some embodiments of the disclosed subject matter.

In some embodiment, the child-resistant feature in accordance with the disclosed subject matter is readily illustrated in FIG. 3. In an interlocked position, fastening strip 240 is entirely embedded into fastening strip 250, where the only exposed surface of fastening strip 240 is the smooth and flat outer surface which does not provide a force-focusing area that can be applied force in order to separate the two fastening strips 240 and 250. Thus, for a child, it would be difficult to open interlocking closure device 120.

In the closure unlocking operation, the first step is to release opening tool 130 from interlocking closure device 120. For example, in some embodiments, opening tool 130 is connected to interlocking closure device 120 by one or more connecting bridges 132. In such an example, a user can release opening tool 130 from interlocking closure device 120 by breaking one or more connecting bridges 132 (e.g., as illustrated in FIG. 4).

Figure 4:
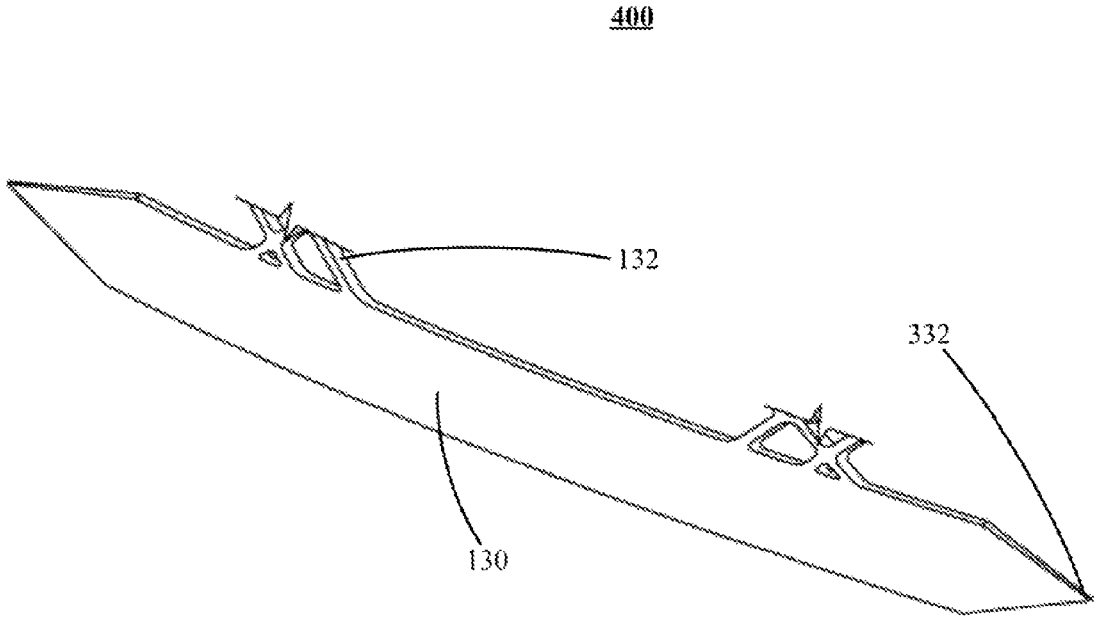
FIG. 4 is a fragmentary view showing an expanded view of an opening tool of a child proof container in accordance with some embodiments of the disclosed subject matter.

FIG. 4 shows an expanded view of a released opening tool of a child proof container in accordance with some embodiments. As illustrated, opening tool 130 has two pointed ends 332. In some embodiments, the material of two pointed ends 332 gradually gets thinner toward the point of ends 332 and is more flexible than the material of the rest part of opening tool 130.

Referring back to FIG. 3, in some embodiments, in each of arcuate sides 128 at the inner side of hand opening 126, a small slit 364 is formed. An insertion of a pointed end 332 of opening tool 130 into one of slits 364 can provide a force-focusing point to apply force or twist in order to separate the two fastening strips 240 and 250. Thus, to open an interlocking closure device 120 from the locked position, a user can insert a pointed end 332 of opening tool 130 into one of slits 364, and use opening tool 130 as a pry bar to separate fastening strips 240 and 250.

In some embodiments, interlocking closure device 120 may be manufactured by injection molding. Generally, interlocking closure device 120 may be formed from any suitable thermoplastic material including, for example, polyethylene, polypropylene, nylon, or the like, or from a combination thereof. Thus, resins or mixtures of resins such as high density polyethylene, medium density polyethylene, and low density polyethylene may be employed to prepare the fastening strips of the present invention. The selection of the appropriate thermoplastic material can be related to the particular size design of the interlocking closure device, the Young's Modulus of the thermoplastic material, and the desired elasticity and flexibility of the fastening strips.

The provision of the examples described herein (as well as clauses phrased as "such as," "e.g.," "including," and the like) should not be interpreted as limiting the claimed subject matter to the specific examples; rather, the examples are intended to illustrate only some of many possible aspects.

Accordingly, child proof containers which have an interlocking closure device and an opening tool are provided.

Although the invention has been described and illustrated in the foregoing illustrative embodiments, it is understood that the present disclosure has been made only by way of example, and that numerous changes in the details of implementation of the invention can be made without departing from the spirit and scope of the invention, which is limited only by the claims that follow. Features of the disclosed embodiments can be combined and rearranged in various ways.

What is claimed is:

1. A child proof container comprising:

a removal tool having a first end;

a pouch with a first edge and a second edge that together form an opening to the pouch;

a first handle portion that is attached to the first edge and that includes an opening sized to receive the first end of the removal tool;

a second handle portion that is attached to the second edge, that is configured to fit into a cavity in the first handle portion, that interlocks with the first handle portion when in the cavity, and that can be pushed out of the first handle portion using the first end of the removal tool, wherein the removal tool is one-piece construction with one of the first handle portion and the second handle portion and can be removed from the one of the first handle portion and the second handle portion by a user.

2. The child proof container of claim 1, wherein the pouch is formed from at least one of plastic polyethylene terephthalate, polyvinyl chloride, polyester, nylon, synthetic resin, polyamide resin, acrylonitrile butadiene styrene, polypropylene, polystyrene, and thermoplastic elastomers.

3. The child proof container of claim 1, wherein the first handle portion is formed from at least one of plastic polyethylene terephthalate, polyvinyl chloride, polyester, nylon, synthetic resin, polyamide resin, acrylonitrile butadiene styrene, polypropylene, polystyrene, and thermoplastic elastomers.

4. The child proof container of claim 1, wherein the second handle portion is formed from at least one of plastic polyethylene terephthalate, polyvinyl chloride, polyester, nylon, synthetic resin, polyamide resin, acrylonitrile butadiene styrene, polypropylene, polystyrene, and thermoplastic elastomers.

5. The child proof container of claim 1, wherein the first handle portion and the second handle portion interlock using a plurality of embossments.

6. The child proof container of claim 5, wherein a portion of the embossments are male shaped and another portion of the embossments are female shaped.

7. The child proof container of claim 1, wherein the first handle portion includes an arcuate side in which the opening is located.

8. The child proof container of claim 7, wherein the arcuate side is sized to be less than about 0.25 inch.

* * * * *